United States Patent [19]

Fisher

[11] 3,979,552

[45] Sept. 7, 1976

[54] COOLANT DISPLACEMENT MATERIAL

[75] Inventor: John L. Fisher, Lexington, Ky.

[73] Assignee: Kuhlman Corporation, Troy, Mich.

[22] Filed: Mar. 11, 1974

[21] Appl. No.: 449,639

[52] U.S. Cl. ..... 174/15 R; 165/104 M; 165/106; 174/175 F; 336/58

[51] Int. Cl.[2] ..... H01F 27/12

[58] Field of Search ..... 165/106, 104; 336/55, 336/57, 58; 174/15 R, 17 SF

[56] References Cited

UNITED STATES PATENTS

| | | | |
|---|---|---|---|
| 1,528,494 | 3/1925 | Lennig | 165/106 X |
| 2,036,068 | 3/1936 | Montsinger | 174/17 SF |
| 3,030,215 | 4/1962 | Veatch et al. | 65/21 X |
| 3,086,898 | 4/1963 | Alford et al. | 65/21 X |
| 3,325,341 | 6/1967 | Shannon | 62/22 X |
| 3,815,575 | 6/1974 | Danis | 165/105 X |

FOREIGN PATENTS OR APPLICATIONS

| | | | |
|---|---|---|---|
| 1,549,536 | 11/1968 | France | 174/17 SF |
| 16,965 | 9/1963 | Japan | 174/17 SF |
| 578,869 | 7/1946 | United Kingdom | 174/17 SF |

OTHER PUBLICATIONS

McGregor, J. E. *Component Support And Cooling* IBM Technical Disclosure Bulletin, vol. 2, No. 5, 2/1960.

*Primary Examiner*—Albert W. Davis
*Attorney, Agent, or Firm*—Harness, Dickey & Pierce

[57] ABSTRACT

A coolant displacement material for a liquid cooled transformer consisting of a plurality of glass spheres having one or more closed voids to provide a specific gravity which is greater than oil so that the glass spheres remain submerged without need for securing devices and is substantially less than the specific gravity of solid glass material so as to not unnecessarily contribute to the weight and consequent shipping cost of the coolant displacement material and the completed transformer assembly. The spheres provide venturi-like flow passages which enhance thermal transfer between the transformer and the coolant by increasing the flow velocity of the coolant to break down surface-effect thermal barriers. The glass spheres are sufficiently small in size to conform to a substantial portion of the space between the transformer and tank. The wall thickness of the spheres at their exterior surface is sufficiently great so that the glass spheres are substantially non-disintegrating during loading of the spheres into the tank.

11 Claims, 4 Drawing Figures

COOLANT DISPLACEMENT MATERIAL

BACKGROUND AND SUMMARY OF THE INVENTION

Increasing demands on the world's natural oil supplies have recently tended to limit the quantities of oil which is made available to manufacturers and oil consumers generally. This has caused great concern in the transformer industry which uses substantial quantities of oil annually to provide the liquid coolant for liquid-cooled transformers.

The patent to Montsinger U.S. Pat. No. 2,036,068 issued Mar. 31, 1936 suggests the replacement of a portion of the liquid coolant for a transformer by spheres of fired clay. The Montsinger approach falls short of commercial promise because fired clay has a specific gravity of more than twice that of the oil which it replaces. Consequently, the use of fired clay as described by Montsinger would substantially increase the shipping costs of the coolant material, the finished structure, and could necessitate redesign of various support structures for the transformer.

In accordance with applicant's invention, a material heretofore used as a thermal insulating medium is used with a reduced amount of liquid coolant, and yet provides effective thermal transfer from a transformer. In this regard, if the amount of liquid coolant in the transformer tank were reduced, and then combined with a thermal insulating material, it would be expected that the total thermal transfer capability would be dramatically reduced. However, in accordance with the present invention, the thermal transfer capability of the liquid coolant is synergistically enhanced by the thermal insulating medium.

The thermal insulating medium used as a coolant displacement material in accordance with the teachings of this invention is preferably a plurality of glass spheres having one or more closed voids. Such spheres are widely known as an insulating medium, for example, see the patent to Alford U.S. Pat. No. 3,086,898 dated Apr. 23, 1963, the patent to Veatch et al. U.S. Pat. No. 2,797,201 issued June 25, 1957, the patent to Veatch et al. U.S. Pat. No. 2,978,340 issued Apr. 4, 1961, and the patent to Veatch et al. U.S. Pat. No. 3,030,215 issued Apr. 17, 1962.

In accordance with the principles of this invention, the glass spheres have a specific gravity which is greater than the specific gravity of oil but substantially less than the specific gravity of solid glass material to minimize shipping costs and yet provide for self-location of the glass spheres. The glass spheres preferably have a diameter which is sufficiently large to provide flow passages of the dimension needed for proper coolant flow, but are sufficiently small so that the glass spheres can occupy most available locations in the transformer and transformer tank and provide a substantial venturi effect. The glass spheres have a wall thickness at their exterior surface which insures the mechanical integrity of the spheres during pouring of the spheres into the tank. The glass material is selected to be substantially inert in the coolant environment and is further selected to have good dielectric characteristics to avoid dielectric breakdown.

DETAILED DESCRIPTION OF THE PREFERRED EMBODIMENT

Figure 1:
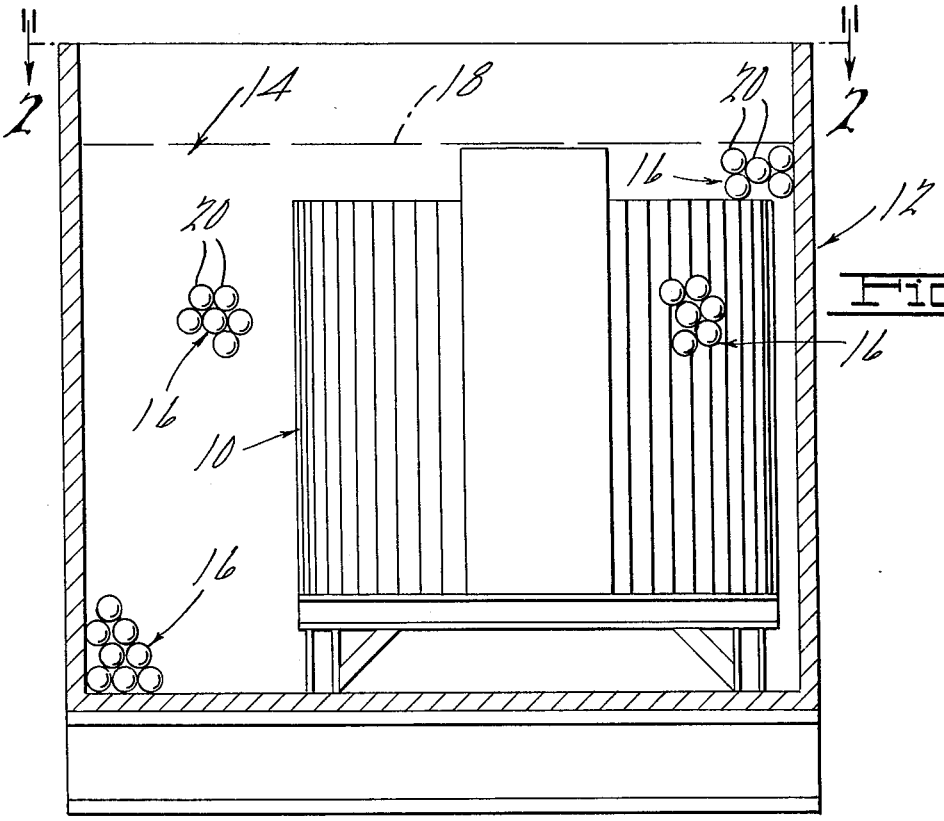
FIG. 1 is a side view, showing a transformer tank in cross section and a transformer in elevation in combination with a coolant liquid and the coolant displacement material of this invention.
Figure 2:
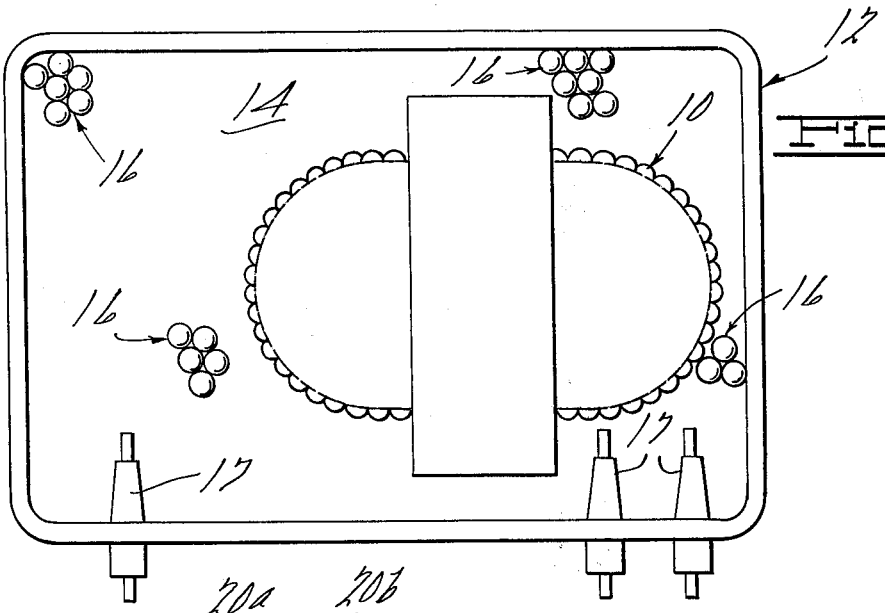
FIG. 2 is a top view of the tank and transformer with the liquid coolant and coolant displacement material of FIG. 1.

In FIGS. 1 and 2, a transformer 10 is shown in combination with a transformer tank 12 for containing a coolant liquid 14 such as oil and a coolant displacement material 16. The transformer 10 is provided with the terminals 17 which are mounted on the tank 12 and operatively connected to the transformer 10 by cables (not shown). Generally, certain spacing requirements must be met with respect to the terminals 17 which contributes to the overall dimensions of the tank 12. The coolant liquid 14 and the coolant displacement material 16 are each loaded into the tank 12 by pouring so as to bring the level of each above the transformer 10 as illustrated by the horizontal dashed line 18. Note that although the coolant displacement material 16 is only sporadically shown, in actuality, it completely fills the tank 12 up to the level 18.

Figure 3:
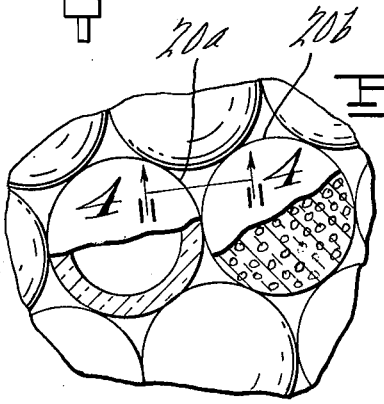
FIG. 3 is an enlarged view of two representative types of coolant displacement materials in accordance with the present invention.
Figure 4:
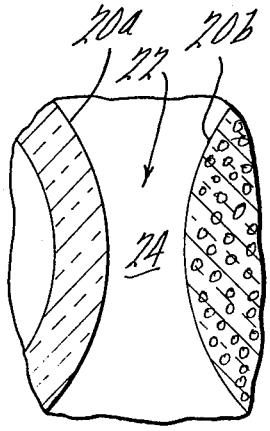
FIG. 4 is a cross-sectional view of the two representative types of displacement materials of FIG. 3 taken generally along the lines 4—4.

The coolant displacement material 16 comprises glass spheres 20 which have one or more internal voids for adjusting the specific gravity of the glass spheres. In accordance with the principles of this invention, the glass spheres 20 have a total volume of voids relative to the total volume of solid material which provides a specific gravity which is at least greater than that of oil, i.e. about 0.89, but which is substantially less than that of solid glass material, i.e. about 2.2. By way of example, a suitable specific gravity would be between 1.0 and 1.8. The specific gravity of hollow glass spheres as illustrated as sphere **20*a* in FIGS. 3 and 4 may be adjusted anywhere within this range by adjusting the relationship between the wall thickness and the diameter of the spheres. The adjustment of the specific gravity of multiple void glass spheres such as spheres constructed of a closed cell glass foam as illustrated as sphere 20*b* in FIGS. 3 and 4 is somewhat more difficult; however, closed cell glass foam may be fabricated having a specific gravity of approximately 1.6. Since the specific gravity is selected to be greater than that of oil, the glass spheres 20** will be self-locating when in an oil environment and will remain generally in place without the need for any additional securing device. Since the specific gravity is substantially less than that of solid glass, the cost of shipping the coolant displacement material to the transformer manufacturer and the cost of shipping the completed transformer with the coolant displacement material to the user will be substantially reduced.

The diameters of the glass spheres is selected so as to be sufficiently small so that the glass spheres will fill most of the space between the transformer 10 and the walls of the tank 12. However, they are sufficiently large in diameter so as to provide suitable flow passages intermediate the glass spheres. This limitation will be better appreciated when the manner in which the thermal energy is transferred from the transformer 10 to the coolant liquid 14 is considered. The high temperature of the exterior surfaces of the transformer 10 causes generally upward and outward convection currents in the coolant liquid 14. These currents flow in the flow passages intermediate the spheres 20 and intermediate the spheres 20 and the transformer 10. Because of the spherical form of the exterior surfaces of the spheres 20, those flow passages are generally venturi-like. This can be best seen with reference to FIG. 4 in which a flow passage 22 is illustrated intermediate adjacent spheres 20*a* and 20*b*. This venturi-like passage causes increased flow velocities at the throat 24 of the venturi passage 22. Some of these throats 24 of flow passages 22 are closely adjacent the exterior surface of the tank 10 so that the exterior surface of the tank 10 is subjected to localized increased flow velocities. These localized increased flow velocities tend to break down the surface-effect thermal barriers so as to enhance the transfer of thermal energy from the exterior surface of the transformer 10 to the coolant liquid 14. As a result of the enhanced thermal transfer from the transformer 10, the thermal insulating effect of the spheres 20 is compensated. A similar effect occurs between the walls of the tank 12 and the coolant liquid 14 except that the convection currents are downward and inward. Accordingly, the venturi-like flow passage enhances thermal transfer from the transformer to the coolant liquid 14 and from the coolant liquid 14 to the walls of the tank 12. If the spheres 20 are of too large a diameter, the passages 22 will be so large as to be inappropriate for the velocity of the thermal convection currents so that the venturi effect is not efficiently utilized. If the glass spheres 20 are too small, the passages 22 are so small as to restrict fluid flow thereby degrading the transfer of thermal energy from the transformer 10. Generally, the glass spheres should be between ½ inch and 1½ inches in diameter with 1 inch diameter glass spheres being preferred.

Preferably, the exterior surface of the spheres 20 is smooth to provide minimal resistance to fluid flow. This is readily accomplished with hollow spheres having a single void such as sphere 20*a* of FIGS. 3 and 4. However, in the case of foam spheres such as sphere 20*b* of FIGS. 3 and 4, the surface may be generally smooth although slightly dimpled and still provide only minimal resistance to fluid flow.

The spheres 20 should be made of a glass material which is inert relative to the coolant liquid 14. In the case of conventional coolant oils, the coolant liquid tends to become slightly acid upon aging. Accordingly, the glass material of the spheres 20 should be resistant to the acidity of the oil when used with conventional coolant oils.

The glass spheres should have good electrical characteristics to prevent dielectric breakdown due to the high voltages to which at least certain of the glass spheres will be subjected. In this regard, the spherical surface of the glass spheres is helpful since it tends to maximize the creepage distance so as to reduce the possibility of creepage breakdown. It is believed at the present time that the glass spheres with multiple voids may have better corona characteristics when in the high voltage environment of the transformer. In addition, it is believed that glass spheres with voids containing nitrogen gas, a known inert gas, may have better dielectric breakdown resistance than glass spheres with voids containing the usual atmospheric gases.

In view of the above description of the invention of this application, it will be appreciated that a commercially viable displacement material for the conventional coolant liquids of transformers has been provided. An important aspect of this invention is that a thermal insulating medium is used to obtain good thermal transfer characteristics. An additional advantage is obtained when the glass spheres of this invention are used since the amount of combustible oil is reduced to reduce the possible consequences of a fire in the vicinity of the transformer.

It is to be understood that the foregoing description is that of preferred embodiments of the invention. Various changes and modifications may be made without departing from the spirit and scope of the invention as defined by the appended claims.

What is claimed is:

1. In combination with a transformer and a tank for containing a coolant liquid for cooling the transformer, cooling means within said tank comprising a coolant liquid and a plurality of members having at least one closed void therein, said members being spherical and constructed of a material which is substantially chemically inert with respect to said coolant liquid and which has a good dielectric characteristic to avoid dielectric breakdown in the high voltage environment of said transformer, said closed void being filled with an inert gas, the ratio of the volume of said material and the volume of said one or more closed voids in each of said members being established to provide a specific gravity of between 1.0 and 1.8, and said spherical members providing venturi-like flow passages for providing increased flow velocities of said coolant liquid to enhance thermal transfer from said transformer to said coolant liquid, being unresilient, and having a diameter between ½ inches and 1½ inches.

2. The combination according to claim 1 wherein said members have a single closed void.

3. The combination according to claim 1 wherein said members have a plurality of closed voids.

4. The combination according to claim 3 wherein said members are constructed of a foam material.

5. The combination according to claim 1 wherein said members are constructed of glass.

6. The combination according to claim 1 wherein said coolant liquid is oil.

7. The combination according to claim 1 wherein said members have a diameter of about 1 inch.

8. The combination according to claim 1 wherein said members have sufficient mechanical integrity so as to prevent substantial breakage upon pouring into said tank.

9. The combination according to claim 8 wherein said members have an exterior wall thickness which provides said sufficient mechanical integrity.

10. The combination according to claim 9 wherein said members are constructed of glass.

11. The invention set forth in claim 1 wherein said inert gas is nitrogen.

* * * * *